US005353106A

United States Patent [19]

Agarwal et al.

[11] Patent Number: 5,353,106

[45] Date of Patent: Oct. 4, 1994

[54] PRESSURE ROLL CLEANER

[75] Inventors: Vinod K. Agarwal, Webster; Harold W. Fletcher, Rochester, both of N.Y.

[73] Assignee: Xerox Corporation, Stamford, Conn.

[21] Appl. No.: 971,034

[22] Filed: Nov. 3, 1992

[51] Int. Cl.[5] ..... G03G 15/20; G03G 21/00

[52] U.S. Cl. ..... 355/283; 15/256.51; 355/284; 355/300

[58] Field of Search ..... 355/283, 284, 300; 15/256.5, 256.51, 256.52

[56] References Cited

U.S. PATENT DOCUMENTS

| | | | |
|---|---|---|---|
| 3,067,720 | 12/1962 | Lewis et al. | 355/254 X |
| 3,099,943 | 8/1963 | Eichorn et al. | 355/233 |
| 3,186,838 | 6/1965 | Graff, Jr. et al. | 355/300 X |
| 3,740,864 | 6/1973 | Ito et al. | 355/300 |
| 3,847,480 | 11/1974 | Fisher | 355/300 X |
| 3,883,921 | 5/1975 | Thettu et al. | 15/256.52 |
| 3,941,558 | 3/1976 | Takiguchi | 355/300 X |
| 3,983,888 | 10/1976 | Edwards | 134/9 |
| 4,568,174 | 2/1986 | Stange | 355/300 |
| 4,686,132 | 8/1987 | Sumii et al. | 428/171 |
| 4,743,943 | 5/1988 | Adams et al. | 355/284 |
| 4,819,026 | 4/1989 | Lange et al. | 355/298 |
| 4,819,031 | 4/1989 | Thayer et al. | 355/298 |
| 4,821,077 | 4/1989 | Hayakawa et al. . | |
| 4,840,267 | 6/1989 | Pine | 15/256.5 X |
| 4,862,221 | 8/1989 | Tabuchi et al. | 355/300 |
| 5,045,890 | 9/1991 | DeBolt et al. | 355/284 |
| 5,049,944 | 9/1991 | DeBolt et al. | 355/284 |

OTHER PUBLICATIONS

Xerox Disclosure Journal, vol. 4, No. 5, Sep./Oct. 1979, pp. 665–666, Photoreceptor Toner Cleaning Member by Bruce E. Thayer.

*Primary Examiner*—Fred L. Braun

*Attorney, Agent, or Firm*—Finnegan, Henderson, Farabow, Garrett & Dunner

[57] ABSTRACT

An apparatus for cleaning a rotatable cylindrical member such as a pressure roll of a fuser assembly includes an absorbent sheet having longitudinal sides joined at a seam and having a generally folded edge along a central longitudinal axis of the absorbent sheet. Rods disposed within the absorbent sheet support the absorbent sheet against the rotatable cylindrical member to clean the circumferential surface of the member as it rotates.

21 Claims, 5 Drawing Sheets

PRESSURE ROLL CLEANER

BACKGROUND OF THE INVENTION

1. Field of the Invention

This invention relates generally to fusers used in the electrophotographic process, and more particularly to a pressure roll cleaner for removing residue from the surface of a pressure roll.

2. Description of the Related Art

The basic xerographic process comprises exposing a charged photoconductive member to a light image of an original document. The irradiated areas of the photoconductive surface are discharged to record an electrostatic latent image corresponding to the original document. A development system moves a developer mix of carrier granules and toner particles into contact with the photoconductor surface. The toner particles are attracted electrostatically from the carrier granules to the latent image forming a toner powder image thereon. The toner powder image is then transferred to a sheet of paper or other support material. This sheet of paper advances to a fuser which permanently affixes the toner powder image to the paper.

The fuser generally comprises a fuser roll, a pressure roll, and an oiling system. The fuser and pressure rolls each have circumferential surfaces in contact with each other. Toner powder is affixed to the paper as the paper passes through a nip between the fuser roll and the pressure roll.

The oiling system applies oil to the surface of the fuser roll for lubrication. As the fuser roll contacts the pressure roll, a portion of the oil on the surface of the fuser roll is transferred to the surface of the pressure roll. Similarly, the fuser roll surface will contain other contaminants such as residual toner powder and paper fibers which are also transferred to the surface of the pressure roll. The oil and other contaminants must be removed from the surface of the pressure roll to prevent this residue from being transferred to the paper as it passes through the nip between the fuser roll and pressure roll. If not, this residue will form a copy quality defect on the paper. As a result, it is desirable to provide an apparatus for removing the residue from the circumferential surface of the pressure roll.

In an attempt to clean the circumferential surface of the pressure roll, a pressure roll cleaner 100, as shown in FIG. 6, was added to the fuser assembly. The conventional pressure roll cleaner 100 consisted of a sheet 11 of absorbent material having a front surface 101 in contact with the surface of the pressure roll. The edges 102 of the absorbent sheet 11 were folded over and stitched to a back surface 103. The pockets between the folded-over edges 102 and seams 104 formed by the stitches received support rods 20, 21 which held the pressure roll cleaner 100 in contact with the pressure roll. An area on the front surface 101 between the two seams 104 of the pressure roll cleaner 100 formed a cleaning surface which collected residue while the pressure roll rotated.

One of the main problems with the conventional pressure roll cleaner 100 was its short user life. Once the front surface 101 became saturated with residual oil and other contaminants, the conventional pressure roll cleaner 100 was discarded and replaced with a new one. The back surface 103 could not be used as a cleaning surface since the folded-over edges 102 formed an irregular surface unsuitable for cleaning. Furthermore, the location of the two seams 104 limited the cleaning area on the front surface 101. The two seams 104 increased the stiffness of the absorbent sheet at these locations, which resulted in inefficient contact with the pressure roll. As a result, the absorbent sheet 11 could not collect residue at areas near the seams 104.

Due to these drawbacks, the conventional pressure roll cleaner had to be replaced frequently (approximately 6–9 times per 1 million prints). The costs associated with the frequent maintenance for replacing the used pressure roll cleaners and the costs associated with stockpiling sufficient numbers of replacement pressure roll cleaners made the design of the conventional pressure roll cleaner undesirable.

The asymmetrical design of the conventional pressure roll cleaner was also disadvantageous if installed improperly. For example, if a user inadvertently installed the conventional pressure roll cleaner with the back surface 103 facing the circumferential surface of the pressure roll, ineffective cleaning would occur and further maintenance would be necessary to reinstall the pressure roll cleaner properly.

SUMMARY OF THE INVENTION

Accordingly, it is an object of the present invention to provide a pressure roll cleaner which has a longer user life.

It is also an object of the invention to provide a pressure roll cleaner which has a larger effective cleaning surface.

It is also an object of the invention to provide a pressure roll cleaner which is easy to install and replace while eliminating the likelihood of installation error.

Additional objects and advantages of the invention will be set forth in the description which follows and in part will become obvious from the description, or may be learned by practice of the invention. The objects and advantages of the invention may be realized and attained by means of the instrumentalities and combinations, particularly pointed out in the appended claims.

To achieve the objects in accordance with the purpose of the invention, as embodied and broadly described herein, there is provided apparatus for cleaning a pressure roll, comprising an absorbent sheet having longitudinal ends joined at a first seam and having a generally folded edge along a central longitudinal axis of the absorbent sheet, and means for supporting the absorbent sheet against the rotatable cylindrical member.

In another embodiment of the invention, there is provided apparatus for cleaning the pressure roll, comprising a seamless tube of absorbent felt and means for supporting the tube against the pressure roll.

DETAILED DESCRIPTION OF THE PREFERRED EMBODIMENTS

Figure 1:
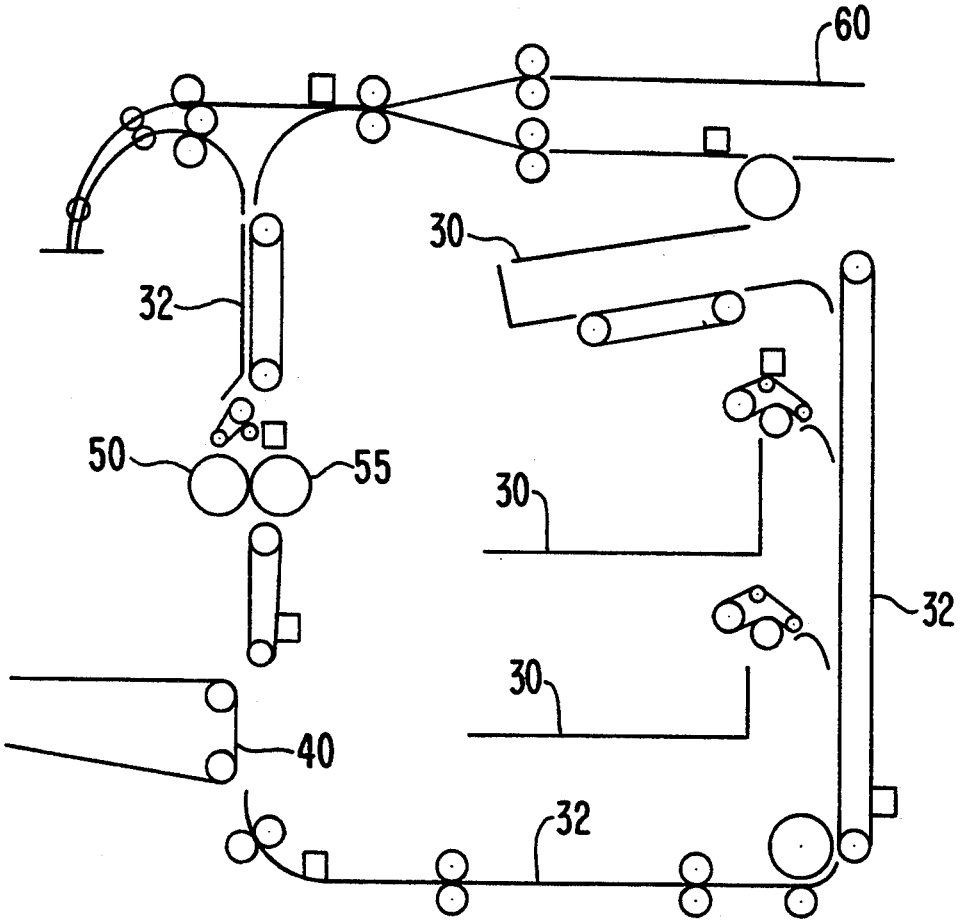
FIG. 1 is an illustration of the paper path of a typical electrophotographic apparatus in which the present invention is used.

FIG. 1 shows the paper path for a typical electrophotographic apparatus. A sheet of paper exits one of the paper holding trays 30 and is transported to the photoreceptor 40 by a paper transport system 32. Toner particles are attracted electrostatically to a latent image formed on the photoreceptor 40. The photoreceptor 40 then transfers the toner powder image to the sheet of paper. The sheet of paper carrying the toner powder image is then transported to a fuser 50 and the toner powder image is permanently affixed to the paper as it passes through the nip between the fuser 50 and the pressure roll 55. The sheet of paper is then transported to an output tray 60.

Figure 2:
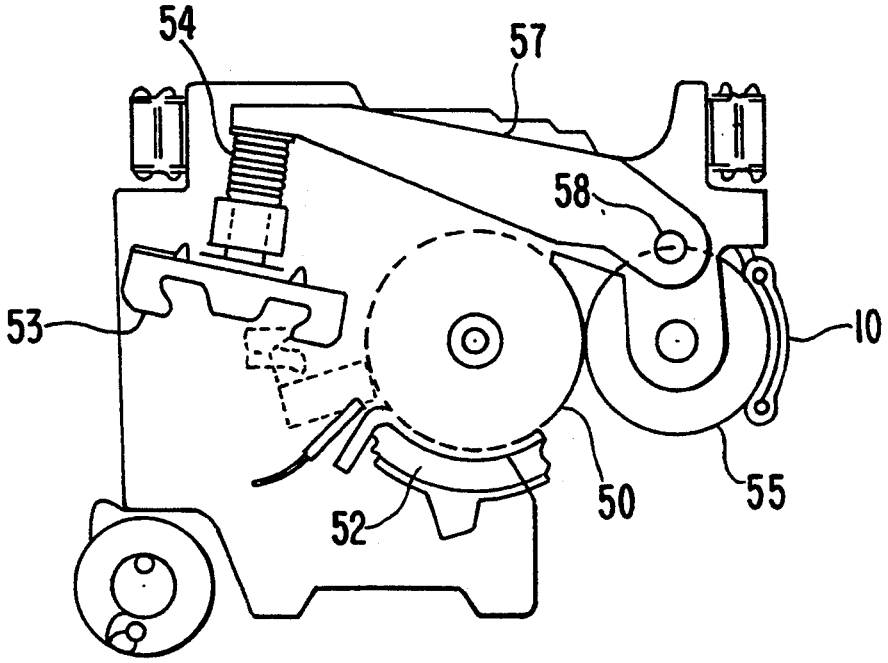
FIG. 2 is a side view of the fuser and pressure roll containing pressure roll cleaner of the present invention.

FIG. 2 shows the components of a fuser assembly, including the pressure roll cleaner of the present invention. The fuser assembly generally comprises a fuser roll 50, a pressure roll 55, an oiling system 52 for applying oil to the fuser roll, a diaphragm 53, spring 54, and a loading arm 57 coupling the pressure roll 55 to the diaphragm 53 and spring 54. The pressure roll cleaner 10 is supported against a surface of the pressure roll at a location which does not interfere with the passing of a sheet of paper through the nip between the fuser roll 50 and the pressure roll 55.

The fuser assembly shown in FIG. 2 is used in electrophotographic apparatus such as the Model Nos. 1075 and 1090 copiers and Model Nos. 4050, 4650, 4090, and 4850 laser printers, all manufactured by Xerox Corporation. However, the pressure roll cleaner of the present invention may be used in any similar fuser assembly or any apparatus where the cleaning of a rotating member is desired.

The fuser assembly operates in the following manner. The diaphragm 53 receives air from a compressor (not shown) and expands. As the diaphragm 53 expands, the spring 54 raises one end of the loading arm 57 to rotate the loading arm 57 around a pivot point 58. The rotation of the loading arm 57 forces the pressure roll 55 against the fuser roll 50 with sufficient force to permanently affix the toner powder image to the sheet of paper as it passes through the nip. The pressure roll 55 rotates in a clockwise direction and the fuser roll 50 rotates in a counterclockwise direction to pull the paper through the nip.

An oiling system 52 applies oil to the surface of the fuser roll 50. A major portion of the oil is transferred to the sheet of paper as it passes through the nip while the remaining portion of the oil is transferred to the pressure roll 55 in contact with the fuser roll 50. Additionally, other contaminants, such as residual toner, are transferred to the pressure roll 55 as they collect on the fuser roll 50.

Figure 3A:
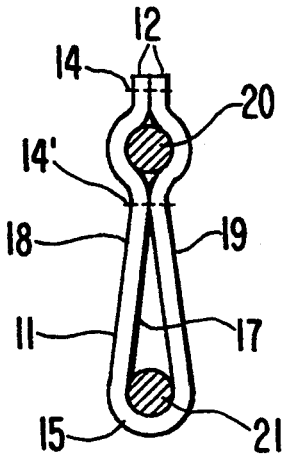
FIGS. 3(*a*)–(*c*) are side views of several embodiments of the pressure roll cleaner of the present invention.
Figure 3B:
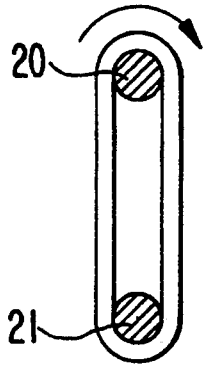
Figure 3C:
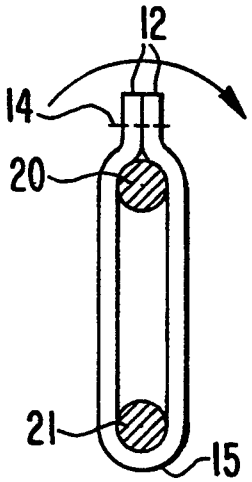
Figure 6:
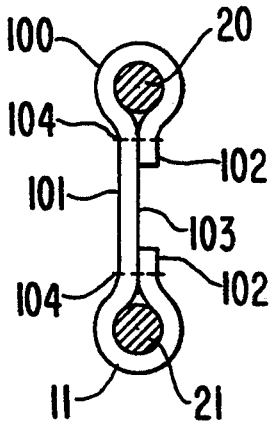
FIG. 6 PRIOR ART
FIG. 6 is a side view of a conventional pressure roll cleaner.
Figure 4:
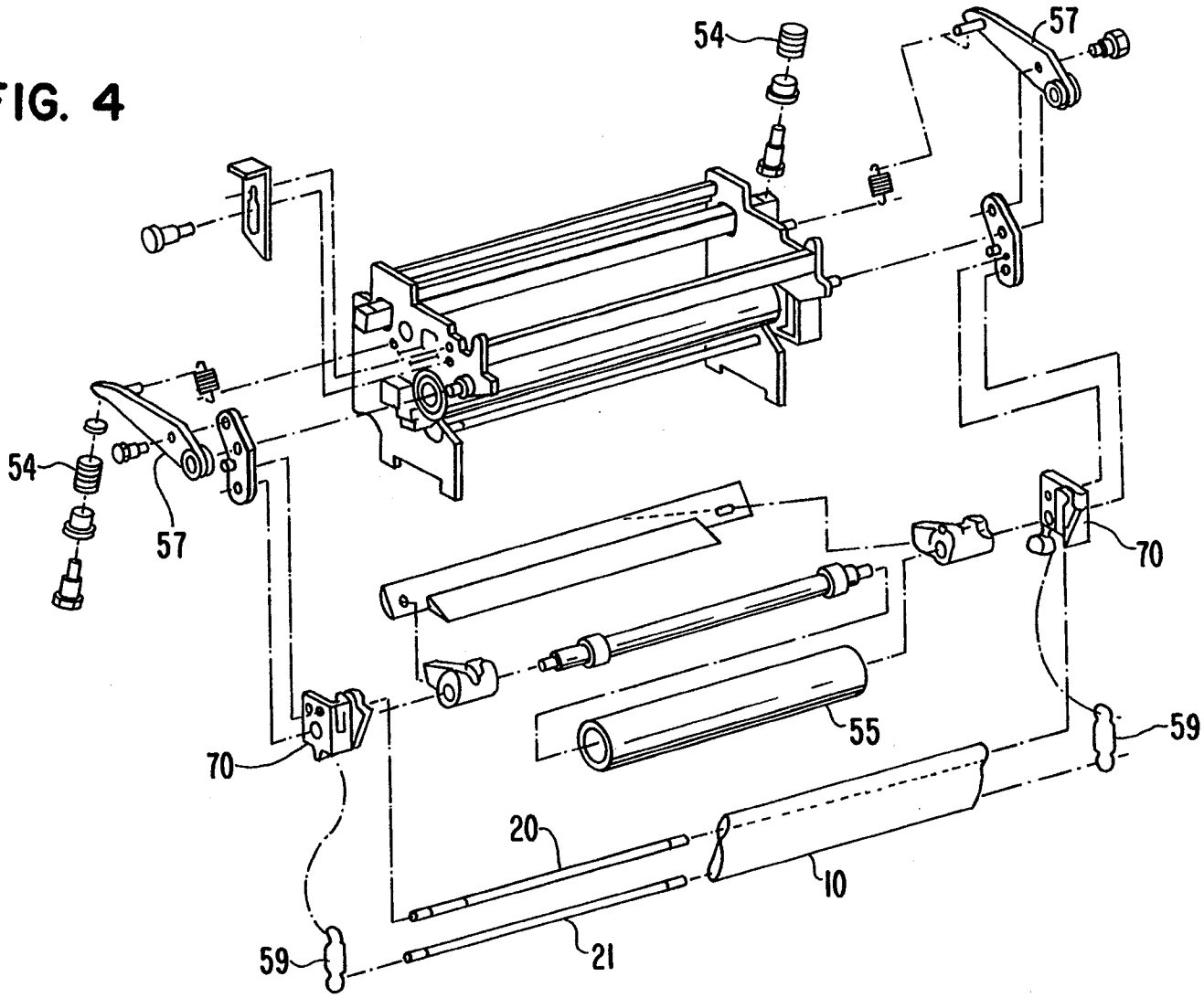
FIG. 4 is a front exploded view of the components of the fuser, including the pressure roll cleaner.

The pressure roll cleaner 10, as shown in FIGS. 3 and 4, includes a sheet 11 of absorbent material supported against the circumferential surface of the pressure roll 55 to absorb the oil and other contaminants collected on the radial surface of the pressure roll.

As shown in FIG. 3(*a*), the absorbent sheet 11 is folded in half longitudinally and the unfolded ends 12 of the absorbent sheet 11 are joined together at two locations with longitudinal stitches. A pocket is formed between two seams 14, 14′ for receiving a support rod 20. The sides 18, 19 of the absorbent sheet 11 between the folded edge 15 and the lower seam 14′ define a cleaning area which contacts the pressure roll.

As shown in FIG. 4, the pressure roll cleaner 10 is supported against the surface of the pressure roll 55 by two support rods 20, 21. The top support rod 20, which is inserted through the pocket formed between the two stitches 14, 14′ of the absorbent sheet 11, is attached to a bracket 70 supporting the pressure roll 55. The bottom support rod 21 rests against the inner folded edge 15 of the absorbent sheet 11. The lower support rod 21 is attached to the bracket 70 with a spring 59 which urges the lower support rod 21 holding the absorbent sheet 11 in contact with the surface of the pressure roll 55. The pressure roll cleaner 10 extends along the entire length of the pressure roll 55.

While two support rods 20, 21 are used to support the absorbent sheet 11 against the pressure roll 55, other means can be used for supporting the absorbent sheet while providing the necessary longitudinal support for holding the absorbent sheet in contact with the pressure roll.

The absorbent sheet 11 may be composed of any absorbent material, such as an absorbent polyester or, preferably, an aramid felt. One type of aramid felt which may be used is NOMEX TM, manufactured by Dupont. Additionally, when the fuser assembly is used in apparatus which generates high temperatures during operation, such as the Model Nos. 1075 and 1090 copiers and Model Nos. 4050, 4650, 4090, and 4850 laser printers manufactured by Xerox Corporation, the absorbent sheet must also be heat resistant. An aramid felt such as NOMEX TM is suitable for high temperature uses.

In the preferred embodiment, a nonabsorbent barrier layer 17, shown in FIG. 3(*a*), is attached to an inner surface of either side of the absorbent sheet. The nonabsorbent layer 17 prevents the accumulated oil and toner from penetrating through one side 18 of the absorbent sheet 11 and being absorbed by the second side 19 of the absorbent sheet 11. The nonabsorbent layer 17 may include a polytetrafluoroethylene (TEFLON) material or any nonabsorbent polyester material. The nonabsorbent layer 17 must also be heat resistant if used in high temperature environments.

The symmetrical design of the pressure roll cleaner 10 allows both sides of the absorbent sheet 11 to be used. When one side 18 of the absorbent sheet has been saturated with residual toner, oil, and other contaminants, the absorbent sheet 11 can be removed from the support rods 20, 21, reversed, and reinserted. The second side 19 can then be used to clean the pressure roll. As a result, the usage life of the pressure roll cleaner of the present invention is twice as long as that of the conventional pressure roll cleaner 100 since the second side of the conventional pressure roll cleaner cannot be effectively used as a cleaning surface.

FIG. 3(*b*) shows a second embodiment of the pressure roll cleaner. The absorbent sheet 11 is formed into a seamless web which is supported by the support rods 20, 21. The manner of supporting the absorbent sheet 11 against the pressure roll 55 is the same as that disclosed in FIG. 4.

FIG. 3(*c*) shows a third embodiment of the pressure roll cleaner. In this embodiment, the absorbent sheet 11 is folded and the unfolded edges 12 are stitched together to form a seam 14 which is located above the top support rod 20. Unlike the embodiment of FIG. 3(*a*), this embodiment has only one seam.

Figure 5:
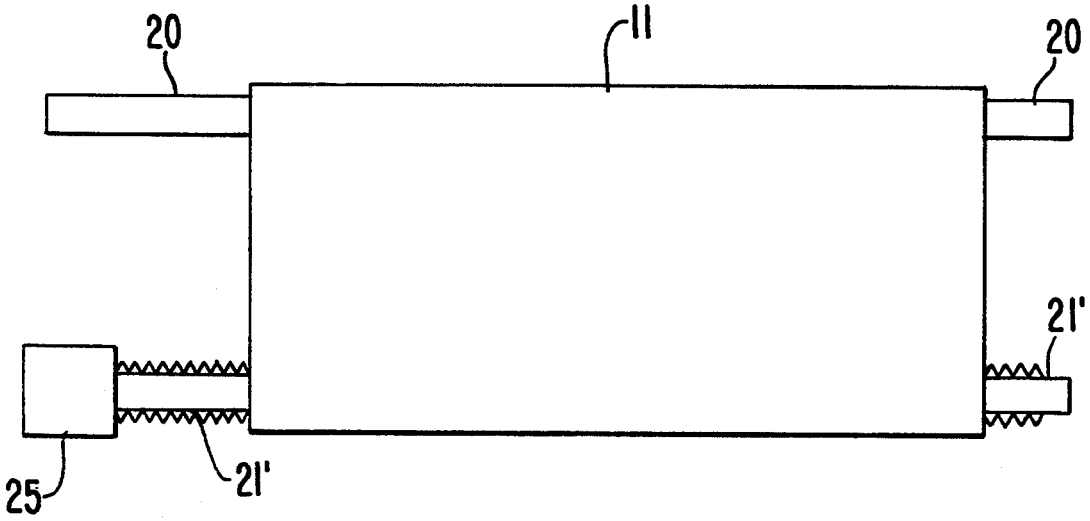
FIG. 5 is a front view of an embodiment of the pressure roll cleaner, including apparatus for indexing the pressure roll cleaner.

In the second and third embodiments shown in FIGS. 3(*b*) and (*c*), the absorbent sheet 11 can be manually or automatically indexed to rotate about the support rods 20, 21. As a result, the entire surface of the absorbent sheet 11 can be used to further increase the usage life of the pressure roll cleaner. As shown in FIG. 5, in order to incrementally rotate the absorbent sheet 11, one of the support rods 21' may be knurled to frictionally grip the absorbent sheet 11. An end of the knurled rod 21' engages a rachet mechanism 25. The knurled support rod 21' and absorbent sheet 11 are rotated by indexing the rachet 25. Any conventional rachet mechanism may be used to accomplish the indexing. Similarly, other indexing apparatus can also be used.

In order to use these two embodiments, means must be included to prevent the absorbent sheet 11 from freely rotating about the support rods as the pressure roll 55 rotates. For example, the rachet 25 or other device for indexing the absorbent sheet 11, in conjunction with the knurled rod 21', can also serve as a means for preventing free rotation of the absorbent sheet 11 about the support rods.

It will be apparent to those skilled in the art that various modifications and variations can be made in the present invention without departing from the spirit or scope of the present invention. Thus, it is intended that the present invention cover the modifications and variations of this invention, provided that they come within the scope of the claims.

We claim:

1. Apparatus for cleaning a cylindrical member rotatable about a longitudinal axis, the apparatus comprising:

an absorbent sheet having longitudinal sides joined together at a seam, a generally folded edge along a central longitudinal axis of the absorbent sheet, and inner and outer surfaces;

a nonabsorbent barrier layer attached to the inner surface of the absorbent sheet; and means for supporting the outer surface of the absorbent sheet against the rotatable cylindrical member.

2. The apparatus of claim 1, wherein the absorbent sheet has a seamless cleaning area between the generally folded edge and the seam.

3. The apparatus of claim 1, wherein the generally folded edge of the absorbent sheet is parallel to the longitudinal axis of the rotatable member.

4. The apparatus of claim 1, wherein the inner surface, the seam, and the generally folded edge of the absorbent sheet define a pocket within the absorbent sheet.

5. The apparatus of claim 4, wherein the support means is disposed within the pocket of the absorbent sheet.

6. The apparatus of claim 4, wherein the support means comprises a first rod disposed within the pocket of the absorbent sheet adjacent and parallel to the folded edge and a second rod disposed within the pocket of the absorbent sheet adjacent and parallel to the seam.

7. The apparatus of claim 1, further comprising a second seam between the seam and the generally folded edge of the absorbent sheet.

8. The apparatus of claim 7, wherein the support means comprises first and second rods and wherein the first rod is disposed between the seam and the second seam.

9. The apparatus of claim 1, wherein the absorbent sheet is an aramid felt material.

10. The apparatus of claim 1, wherein the absorbent sheet is heat resistant.

11. The apparatus of claim 1, wherein the absorbent sheet is an absorbent polyester material.

12. The apparatus of claim 1, wherein the nonabsorbent barrier layer is composed of polytetrafluoroethylene.

13. The apparatus of claim 1, wherein the nonabsorbent barrier layer is heat resistant.

14. The apparatus of claim 1, further comprising means for incrementally rotating the absorbent sheet about the support means.

15. The apparatus of claim 1, further comprising means for preventing the absorbent sheet from freely rotating about the support means.

16. The apparatus of claim 1, further comprising means for moving the absorbent sheet into and out of contact with the rotatable member.

17. The apparatus of claim 1, wherein the rotatable cylindrical member is a pressure roll used in a fuser assembly of a xerographic machine.

18. Apparatus for cleaning a cylindrical member rotatable about a longitudinal axis, the apparatus comprising:

a seamless tube of absorbent felt having an inner surface and an outer surface;

a non-absorbent barrier layer attached to the inner surface of the seamless tube; and means for supporting the outer surface of the tube against the rotatable cylindrical member.

19. The apparatus of claim 18, further comprising means for incrementally rotating the tube about the support means.

20. A fuser apparatus, comprising:

a fuser roll;

a pressure roll having a peripheral surface which contacts the fuser roll; and means for cleaning the peripheral surface of the pressure roll, including an absorbent sheet having longitudinal sides joined together at a seam, a generally folded edge along a central longitudinal axis of the absorbent sheet, and inner and outer surfaces, a nonabsorbent barrier layer attached to the inner surface of the absorbent sheet, and means for supporting the outer surface of the absorbent sheet against the peripheral surface of the pressure roll.

21. A fuser apparatus, comprising:

a fuser roll;

a pressure roll having a peripheral surface which contacts the fuser roll; and means for cleaning the peripheral surface of the pressure roll, including a seamless tube of absorbent felt having an inner surface and an outer surface, a non-absorbent barrier layer attached to the inner surface of the seamless tube, and means for supporting the outer surface of the tube against the pressure roll.

* * * * *